US005697858A

United States Patent [19]

Lekavich

[11] Patent Number: 5,697,858

[45] Date of Patent: Dec. 16, 1997

[54] GAME PUCK AND METHOD FOR CONSTRUCTION THEREOF

[76] Inventor: Carl W. Lekavich, P.O. Box 910, Lomita, Calif. 90717

[21] Appl. No.: 512,759

[22] Filed: Aug. 9, 1995

[51] Int. Cl.[6] ..... A63B 1/00

[52] U.S. Cl. ..... 473/588

[58] Field of Search ..... 273/128 R, 128 CS, 273/128 A; 411/338, 339, 510; 473/588, 589

[56] References Cited

U.S. PATENT DOCUMENTS

| | | | |
|---|---|---|---|
| 150,060 | 4/1874 | Lapham | 411/338 X |
| 607,315 | 7/1898 | Wingard | 411/338 X |
| 1,418,314 | 6/1922 | McBee | 411/338 |
| 2,201,551 | 5/1940 | Welk | 411/339 |
| 3,675,928 | 7/1972 | Gentile . | |
| 3,726,526 | 4/1973 | Radovich . | |
| 3,784,204 | 1/1974 | Felber . | |
| 4,078,801 | 3/1978 | White, Sr. | 273/128 R |
| 4,111,419 | 9/1978 | Pellegrino | 273/128 R |
| 4,793,769 | 12/1988 | Dolan . | |
| 5,074,696 | 12/1991 | Tanaka | 411/339 X |
| 5,207,720 | 5/1993 | Shepherd . | |
| 5,275,410 | 1/1994 | Bellehumeur . | |
| 5,366,219 | 11/1994 | Salcer et al. . | |
| 5,482,274 | 1/1996 | Bellehumeur | 273/128 R |

*Primary Examiner*—Raleigh W. Chiu
*Attorney, Agent, or Firm*—Richard C. Litman

[57] ABSTRACT

A game puck including an integrally-constructed core, core-circumscribing spring and spring-circumscribing shell. The core has a central throughbore in which a center weight may be received. The center weight has interchangeable logo surfaces. The spring is formed by a plurality of concentric folds. The shell has a plurality of throughbores radially diverged therein, each receiving a glide pin. The glide pins each have heads which protrude from each face of the puck. The invention provides a method for making the game pucks including providing a mold for forming a puck and injecting material therein via a centrally-disposed fan gate for discouraging angularly anisotropic properties and cold joint formation.

13 Claims, 4 Drawing Sheets

GAME PUCK AND METHOD FOR CONSTRUCTION THEREOF

BACKGROUND OF THE INVENTION

1. Field of the Invention

This invention relates to games involving projectiles. More specifically, the present invention relates to the projectile or puck used in a game.

2. Description of the Prior Art

In-line skates have inspired renewed interest in playing street hockey. Similar to ice hockey, the players drive a puck into an opposing team's goal to score points. Unlike in ice hockey, the puck typically does not slide as easily along a street hockey playing surface, typically cement or asphalt, as it would on ice. Players often must retrace their paths to reclaim the reluctant projectile, slowing the game and making it less enjoyable. Many times, the puck flips up on edge and rolls across the playing surface rather than playing flat, or sliding along on one of the two faces. Another problem with using a conventional street hockey puck to play roller hockey is that it tends to rebound off objects with high energy at unpredictable trajectories. As roller hockey technology improves, players become less tolerant of inadequate playing action provided by conventional hockey pucks. A need exists for a puck that glides easily on a street or court hockey playing surface, tends to play flat and provides low-energy rebound action and discourages rolling on edge.

Several types of game pucks are described in the patent literature. Unfortunately, the apparatuses described do not predispose a puck to play flat or have structures that reduce the speed and haphazard rebounding action of a puck. For example, U.S. Pat. No. 3,675,928, issued Jul. 11, 1972, to Salvatore A. Gentile, describes an impact safety game puck. The apparatus includes a solid core with a peripherally-disposed annular chamber. A second embodiment includes a thin disk having two faces and a wide, peripherally-disposed annular chamber, defining bowl-shaped cavities in each face of the disk.

U.S. Pat. No. 3,726,526, issued Apr. 10, 1973, to Leroy N. Radovich, describes a multi-purpose game puck. The device includes a solid core having an upper face, a lower face and an annular surface. The device has a central recess and a plurality of indented surfaces radially diverged in each face.

U.S. Pat. No. 3,784,204, issued Jan. 8, 1974, to Julius Felber, describes a hockey puck. The apparatus includes a solid core having an upper face, a lower face and an annular surface. The apparatus has central recesses in each face. The apparatus includes a plurality of spherical rollers radially diverged and slidingly maintained on each face.

U.S. Pat. No. 4,793,769, issued Dec. 27, 1988, to Michael Dolan, describes a hockey puck. The device includes a solid core having an upper face, a lower face and an annular surface. The device includes a plurality of ball bearings, radially diverged and slidingly received in the core. The ball bearings protrude through each face.

U.S. Pat. No. 5,207,720, issued May 4, 1993, to Charles G. Shepherd, describes a hockey puck device. The device includes a first housing and a second housing which threadingly interengage, defining a cavity. Gage means are disposed within the cavity for measuring impact forces.

U.S. Pat. No. 5,275,410, issued Jan. 4, 1994, to Alex R. Bellehumeur et al., describes a puck for use on a non-ice surface. The apparatus includes a solid core having an upper face, a lower face and an annular surface. The apparatus has a plurality of annular slots and throughbores radially diverged therethrough. The slots provide spring means that deform on impact. Stainless steel or polyurethane runners are received in each throughbore, each having head protruding above each face. One embodiment of a runner shows it formed in two pieces. In particular, as shown in FIG. 17, one piece has an axial bore with interior annular teeth that engage with the exterior annular teeth of the second piece inserted therein.

U.S. Pat. No. 5,366,219, issued Nov. 22, 1994, to William Salcer et al., describes a hockey puck. The device includes an insert member over which plastic material is molded. The finished device has an upper face, a lower face and an annular surface. The insert has runners that protrude through and are radially diverged about the periphery of each face. The runners are constructed from nylon, possibly blended with "Kevlar™."

Clearly, the above demonstrates a need for a game puck including positive spring means, circumferentially disposed, providing predictable, low-energy rebound action.

None of the above references, taken alone or in combination, are seen as teaching or suggesting the presently claimed game puck.

SUMMARY OF THE INVENTION

The present invention overcomes the limitations of the above inventions by providing a game puck including weight means that predispose the puck to play flat, and positive spring means that provides low-energy rebound action. The invention includes a disc-shaped core having a central throughbore. One of a number of center weights may be received in the throughbore to adjust the weight of the puck to suit the level of play. The center weight has massive portions outwardly-disposed that tend to urge the puck to slide on one of its faces rather than rolling on edge.

An annular spring circumscribes and mounts on the core. The spring is formed with concentric folds of plastic material. A shell circumscribes and mounts on the annular spring. When force is applied to the shell, it urges the folds to compress until the force is equally and oppositely repelled. Once the force is overcome, the folds expand and urge the shell outwardly. Preferably, the core, annular spring and shell are constructed integrally, defining an upper face, a lower face and an annular surface.

The shell has a plurality of throughbores radially diverged and interposed between the upper and lower faces of the puck. An oversized, two-piece glide pin is received in each throughbore. Each piece has teeth that align and interengage when the glide pin is assembled in a throughbore. The oversized pins locally bulge the material about the receiving throughbore and generate annular flat spots between neighboring pins. Each glide pin has a first head that protrudes beyond the upper face and a second head that protrudes beyond the lower face. The puck traverses the street hockey playing surface with minimal friction on the heads of the glide pins.

The invention also provides a method for constructing a puck. The method includes providing a mold having a cavity defining the outer surface of a puck and injecting polyvinylchloride through the sprue into the cavity. The injected material flows outwardly from the center of the mold, deterring annularly anisotropic characteristics or cold joint formation. The method enhances the balance of the puck so formed. The method also includes setting the plastic material and ejecting the puck from the mold.

In consideration of the above, an object of the invention is to provide a game puck that has a center weight with outwardly-disposed massive portions that predispose the puck to slide along on one of its faces rather than roll about its annular surface.

Another object of the invention is to provide a game puck that includes an annular spring including a plurality of concentric folds that provides for low-energy rebound action.

A further object of the invention is to provide a game puck that includes glide pins with heads that contact the playing surface, enhancing the sliding capabilities of the puck.

An additional object of the invention is to provide a game puck that includes interchangeable glide pins with teeth that self align and interengage when received in the game puck.

Yet another object of the invention is to provide a method for constructing a game puck that reduces annular anisotropic characteristics or cold joint formation therein.

Yet a further object of the invention is to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features of the invention consistently throughout the attached drawings.

DETAILED DESCRIPTION OF THE PREFERRED EMBODIMENTS

1. GAME PUCK

Figure 1:
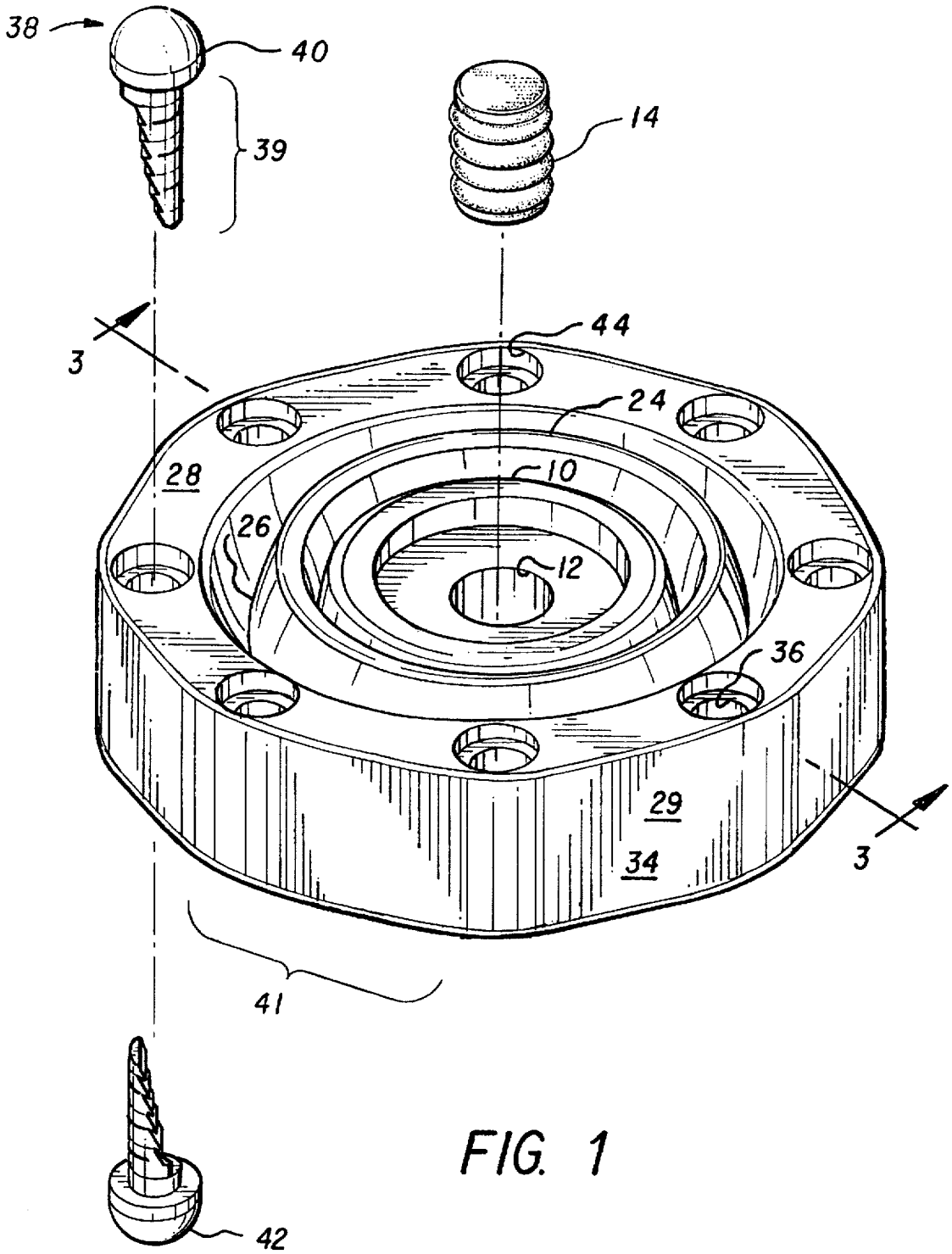
FIG. 1 is a top front perspective view of the invention having received a first embodiment of a center weight and showing a glide pin in exploded perspective.
Figure 3:
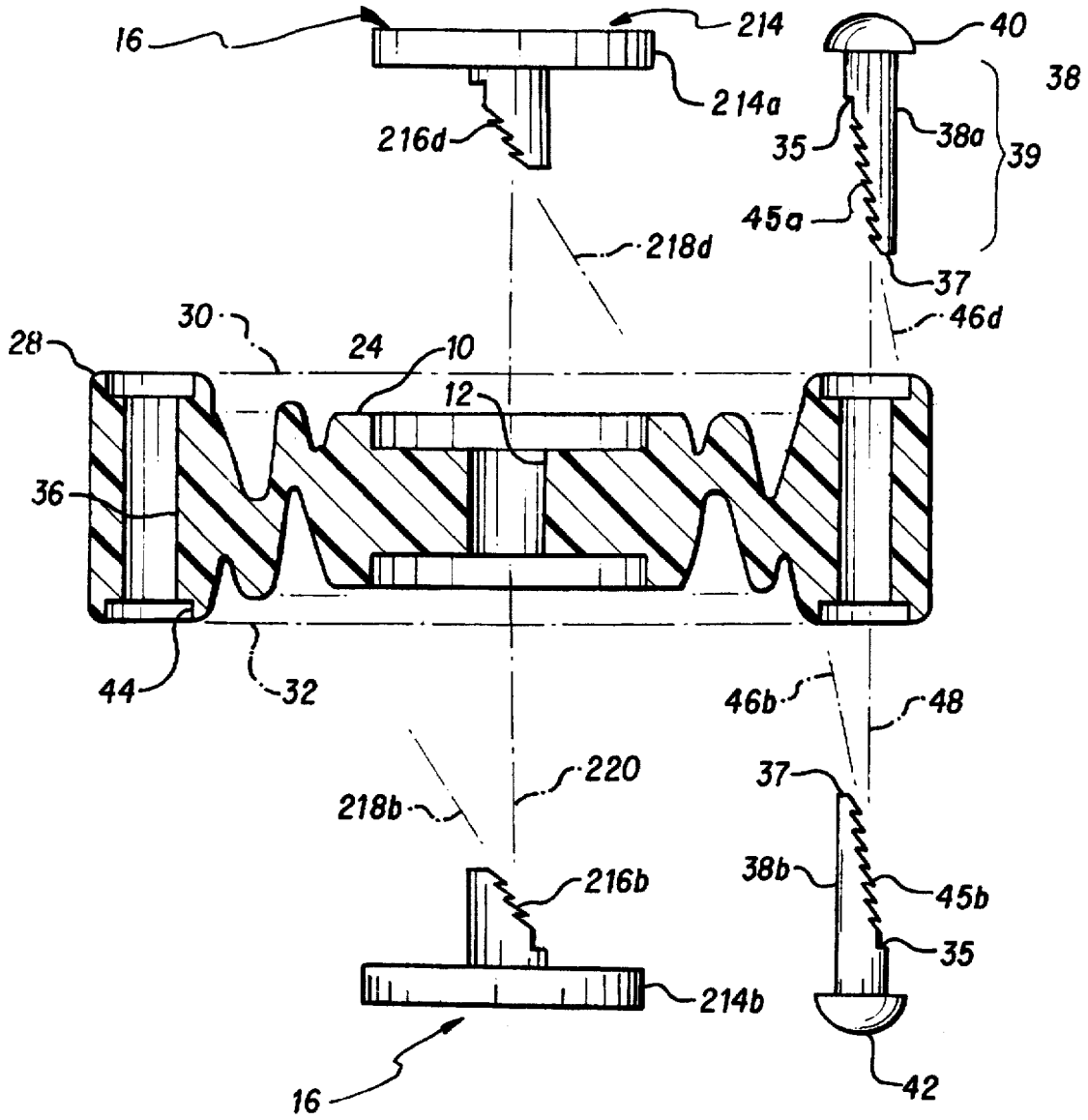
FIG. 3 is a longitudinal cross-sectional detail view of the invention drawn across line 3—3 in FIG. 1, further illustrating a glide pin and a third embodiment of a center weight in exploded perspective.

Referring to FIGS. 1 and 3, the invention includes a disc-shaped core 10 having a central throughbore 12. The core 10 is constructed from polyvinylchloride, "PVC" hereinafter, formulated with high- and low-temperature plasticizers. The plasticizers maintain relatively constant durometer within the PVC between temperatures of 50° through 100° Fahrenheit (F.). Maintaining constant durometer in a material through a range of temperatures provides desirable constant density, deflection and expansion properties. These consistent properties provide street hockey players with a puck having predictable playing characteristics. A puck having predictable playing characteristics reduces the variables players must master. Limiting the number of variables permits players to improve their skills rapidly.

In FIG. 1, a first embodiment of a center weight 14 is shown being received in the throughbore 12. Preferably, the center weight 14 is constructed from a brass composition. However, any material having various massive characteristics may be employed to engender the puck with differing playing characteristics.

Figure 2:
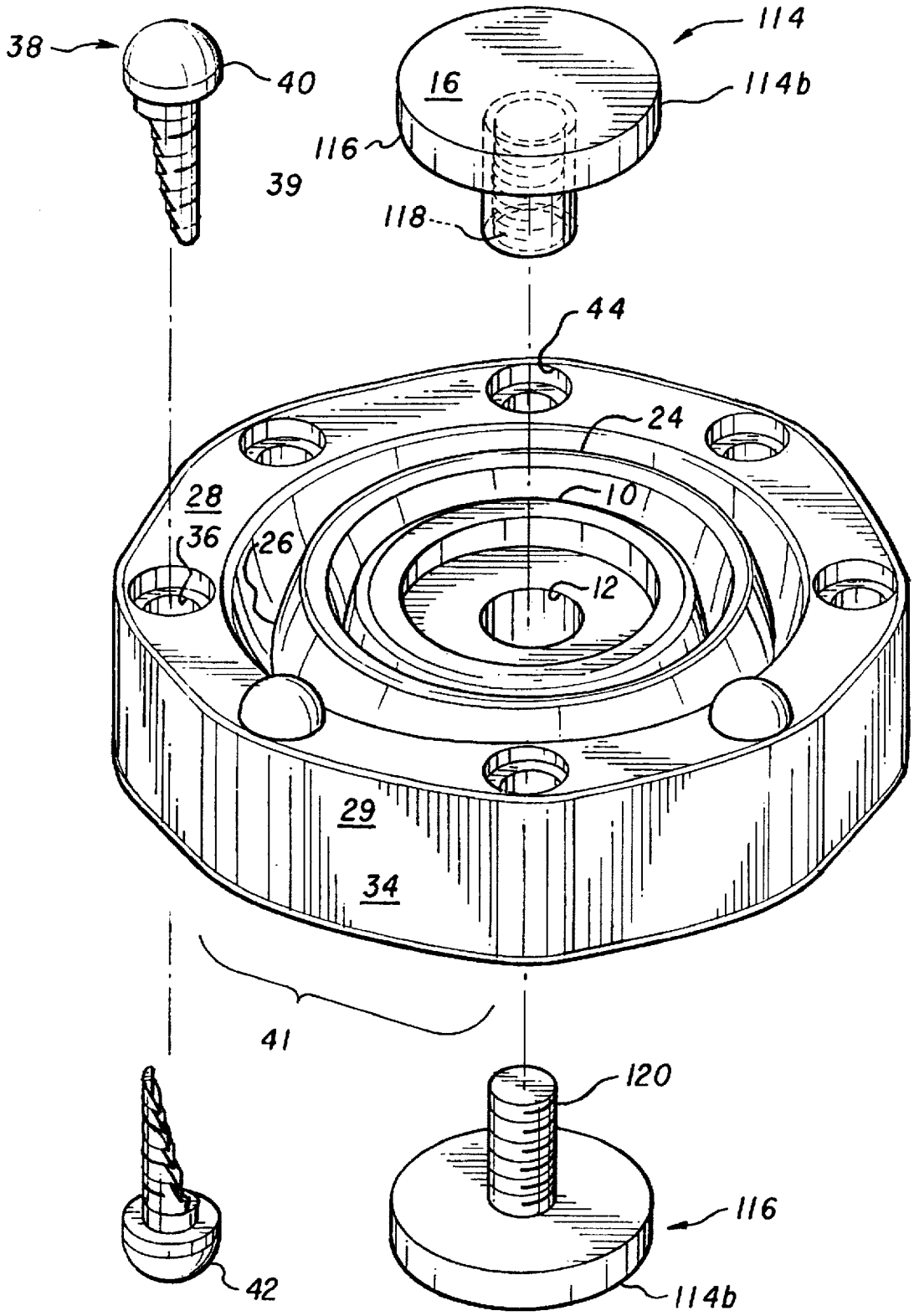
FIG. 2 is a top front perspective view of the invention having received a second embodiment of a center weight and showing a glide pin in exploded perspective.

Referring to FIG. 2, the invention includes a second embodiment of the center weight 114. The center weight 114 is configured having outwardly-disposed massive portions 116 proximate to a first face 30 and second face 32 of the puck. The outwardly-disposed massive portions 116 urge the puck to play flatly, rather than rolling on its edge; gravity pulls the heaviest portions of the puck, the massive portions 116, toward the lowest energy state. The center weight 114 is shown formed in two pieces, **114*a* and 114*b*. The first piece 114*a* has a threaded bore 118 and the second piece 114*b* has a exterior annular threads 120 that threadingly engage with the threads of the threaded bore 118**.

Referring to FIG. 3, the invention provides for a third embodiment of the center weight 214 also composed of two pieces, **214*a* and 214*b*. Each piece 214*a* and 214*b* has teeth, 216*a* and 216*b*, respectively, disposed on planes, 218*a* and 218*b*, respectively, that are obtuse to the central axis 220 of the center weight 214. When the planes 218*a* and 218*b* are urged to mate, the teeth 216*a* and 216*b* interengage, securing the center weight 214 to the core 10**.

A set of center weights (not shown) may be provided, being several in number and varying in weight such that the overall weight of the puck varies from about 90 grams to 150 grams, for example. Thus, a set of center weights provides players with a puck having different weights, depending on the players' needs and skill levels. A lighter center weight may be selected to reduce the momentum of the puck and lessen the rebounding action. A heavier center weight may be selected to increase the tendency of the puck playing flat, which may be especially useful when playing on rough surfaces or in professional Roller Hockey leagues.

The center weights 114 and 214 each have faces 16 on which the logo of a manufacturer may be disposed, such as "Ideal Design Sports, Inc."

A spring 24 circumscribes and mounts on the core. The spring 24 is made up of a plurality of concentric folds 26 or corrugations, a novel structure not shown in the prior art for game pucks. When the puck is driven against an object, the spring 24 compresses in an accordion-like manner and exerts a spring force against the object proportional to the amount the spring 24 deflects until it arrests the momentum of the puck. The spring 24 has a high spring constant to withstand the high impact forces the puck repeatedly endures. Once the momentum of puck is retarded, the spring 24 expands and rebounds the puck away from the object according to well-known laws of physics. Since the folds 26 encircle the core 10 uniformly, the spring 24 exerts the same spring force regardless of what point on the circumference of the spring 24 is deflected. The cross-sectional thickness of the folds 26 of the spring 24 may be increased or decreased according to the weight and rebound action demanded by the user. This circumferential uniformity aids players in predicting the rebound of the puck after it is driven into an object. This rebound action may be adjusted by introduction of various center weights, as discussed above.

The unique spring 24 provides a puck having a more dampened rebound than provided by prior art game pucks. For example, U.S. Pat. No. 5,275,410, discussed supra, describes a puck having annular slots that permit the outwardly adjacent material, essentially a beam under solid mechanics theory, to deflect inwardly on impact. The puck relies on the ability of the beam to assume its design position quickly to provide for rebounding. However, the puck may not always strike the beam portion of the puck. Rather, when the puck strikes an object with the solid portion located between the slots, the puck rebounds sharply and unpredictably. The instant invention relies on an angularly uniform plurality of folds 26 that compress much like a helical spring. Regardless of where the spring 24 is deflected, the folds 26 are compressed in a similar manner. The spring 24 imparts the same spring force against the object regardless of annular orientation therealong.

The invention includes a shell 28 that circumscribes and mounts on the spring 24. When force is applied to the shell 28, the shell 28 urges the spring 24 to compress. The shell 28 may be fabricated such that it deforms on impact, as described in U.S. Pat. No. 5,275,410, discussed supra. However, the spring 24 is purposed at absorbing impact and providing the brunt of the rebound action. Preferably, the shell 28 has a knurled annular surface 29 for better stick handling.

Preferably, the core 10, spring 24 and shell 28 define an upper face 30, a lower face 32 and an annular surface 34. One of the primary points of novelty of the present invention is the spring 24. The folds 26 that make up the spring 24 are equally applicable in game pucks having other than disk shapes.

Preferably, the core 10, spring 24 and shell 28 are integrally constructed. Integral construction permits large-scale injection molding that is inherently less expensive than production and assembly of multiple parts.

The shell 28 has a plurality of throughbores 36 radially diverged about and interposed between the upper face 30 and lower face 32 of the puck.

A glide pin 38 is received in each throughbore 36. As best seen in FIG. 3, the glide pin 38 is shown having a first head 40, which protrudes beyond the upper face 30, and a second head 42, which protrudes beyond the lower face 32. Each head 40 and 42 has a larger diameter than the throughbore 38 receiving the glide pin 38, to assure that the glide pin 38 does not separate from the puck. Each head 40 and 42 is shown received in a counterbore 44 at each end of and coincident with each throughbore 36. The counterbores 44 lend stability to the glide pin 38. Were the glide pin 38 not securely held in place, the pin would vibrate as the puck traverses a coarse playing surface, dissipating the kinetic energy of the puck and reducing the desired play speed.

The glide pin 38 is constructed from hard thermal plastic polymer with a durometer within the range of 70 to 100 shore on the "D" scale. Additionally, the polymer includes 5 to 40 per-cent fiber fill to enhance stiffness as is well known in the art of polymerization. Material having this durometer generally has enhanced lubricity, a characteristic which is exploited to considerable benefit. The enhanced lubricity reduces the coefficient of friction between the glide pin 38 and a playing surface, providing faster play. A glide pin 38 may be replaced by clipping off one of the heads 40 or 42 and inserting a new glide pin 38. Glide pins 38 having different durometers and lubricity characteristics may be inserted in each throughbore 36 to provide the puck a variety of friction coefficients for different playing surfaces.

As best seen in FIG. 3, the glide pin 38 is shown formed from two members, **38*a* and 38*b*. Each member 38*a* and 38*b* has teeth 45*a* and 45*b* disposed on planes 46*d* and 46*b* at a predetermined angle relative to the longitudinal axis 48 of the glide pin 38. The teeth 45*a* and 45*b*, when the planes 46*d* and 46*b* are urged to mate, interengage, permanently securing the glide pin 38 in its respective throughbore 36. In other words, the construction is similar to that provided for the center weight 14. Each member 38*a* and 38*b* terminates in a blunt tip 37. When member 38*a* or 38*b* is fully inserted in the throughbore 36, each blunt tip 37 abuts a complementary shoulder 35 on the mating member 38*a* or 38*b***.

As best shown in FIGS. 1 and 2, the shank 39 of each glide pin 38, when the two pieces **38*a* and 38*b* are joined, has a larger diameter than the throughbore 36 in which it is received. The glide pin 38 bulges the surrounding material locally and creates flat spots 41 on the annular surface 34 of the puck. The flat spots 41 are angularly disposed between the throughbores 36. In the event the puck begins to roll on its annular surface 34, the flat spots 41 upset the motion of the puck and, in combination with configuration of center weight 14**, urge the puck to play flat.

2. METHOD FOR CONSTRUCTION OF A GAME PUCK

Figure 4:
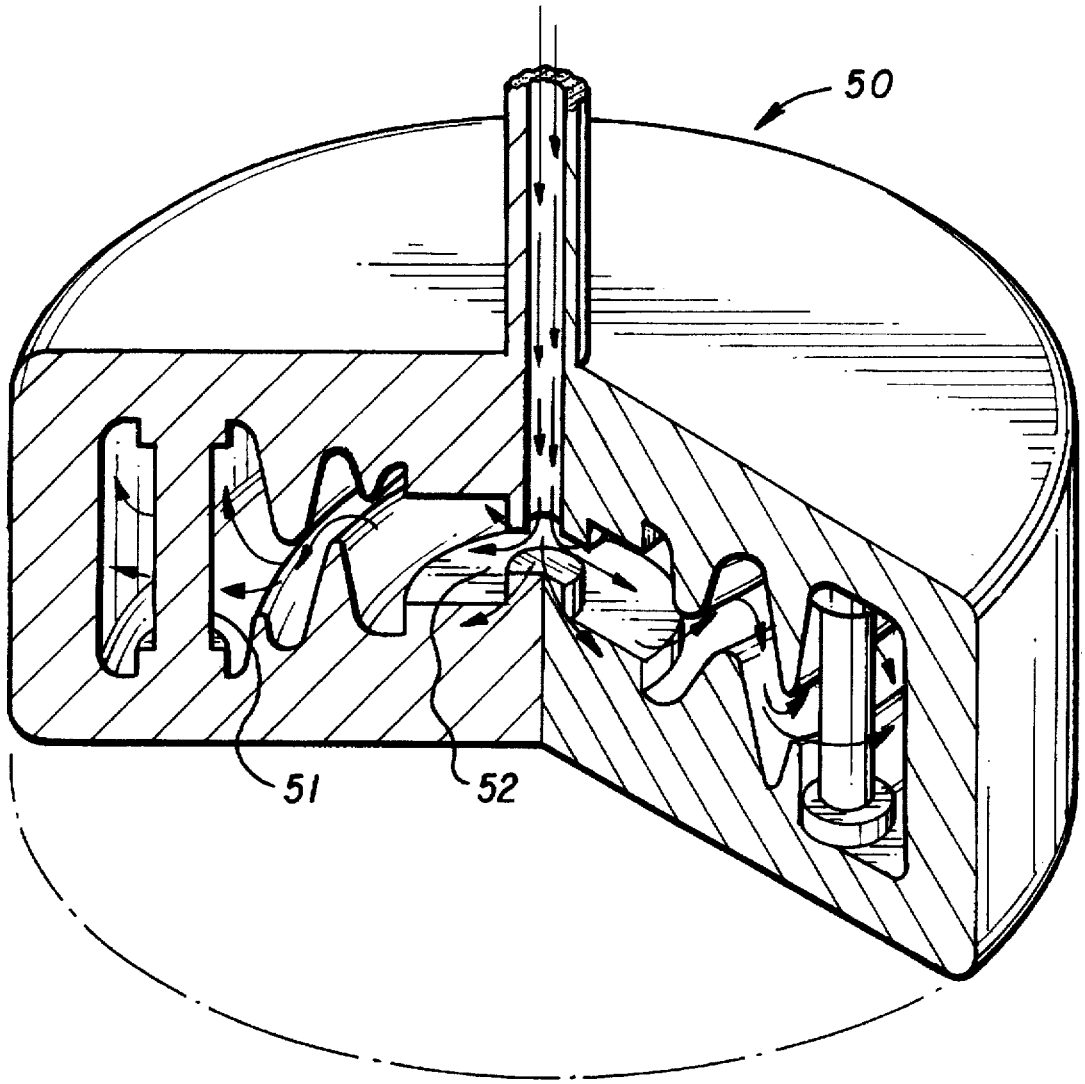
FIG. 4 is a diagrammatic view of the mold and injection direction.

Referring to FIG. 4, the invention provides a method for constructing a puck such as the one described above. The method includes providing a mold 50 having a cavity defining the outer surface of a puck. The mold 50 includes a predetermined number of casting cores 51 around which the injected material must flow. For example, as shown in FIGS. 1 and 2, the puck described above has a central throughbore 12 and predetermined number of radially-diverged throughbores 36.

The invention includes the step of injecting material into the mold 50 through a centrally-disposed fan gate 52. The central location of the fan gate 52 represents a point of novelty not found in the prior art. Typically, prior art pucks, as well as the instant puck, would be produced in molds having laterally-disposed gates. Hot plastic material flows from the laterally-disposed gates through the mold cavity and around the casting cores therein. As the plastic flows, it cools. By the time the plastic material has reached the farthest point from the gate, the material has begun to set. This is significant in two ways.

First, the material delivered into the mold has a density proximal to the gate significantly variant from that of the material distal to the gate. Nonuniform density introduces imbalance and thermally-sensitive concentricity. Imbalance occurs when a body has nonuniform mass. A puck constructed of material with lesser and greater density portions dichotomously ordered has nonuniform mass. Thermally-sensitive concentricity occurs when, as the temperature of the body increases, the body expands in a nonuniform manner and goes out of round. Bodies having anisotropic density characteristics expand non-uniformly as temperature increases.

Second, casting cores force flowing plastic material to part and form two streams. Theoretically, the streams are supposed to merge, forming a uniform mass. However, with respect to casting cores distal to the gate, the plastic material has cooled considerably prior to its bifurcation. Rather than the streams merging once past the casting core, the skins of each stream may adhere, forming a cold joint. Cold joints introduce anisotropic characteristics in the molded body.

A player may realize the effects of imbalance, non-concentricity and/or anisotropically-diverged cold joints in the form of puck wobble, skewed trajectory and unpredictable rebounding. A cold joint also tends to fail, introducing a stress node along which the puck may crack. The present invention, by providing for a central fan gate, has a shorter distance over which to flow than a mold constructed with laterally-disposed gate. The shorter distance reduces the density discrepancies within the puck. Centrally-disposed fan gate also reduce the opportunities for cold joints to form. Even if cold joints did form, they would be isotropically-diverged within the body.

The method further includes setting the plastic material and ejecting the puck from the mold, as is well known in the art The present invention is not intended to be limited to the embodiments described above, but to encompass any and all embodiments within the scope of the following claims.

I claim:

1. A puck comprising:

a core;

a shell disposed about said core; and spring means for introducing bias between said core and said shell, said spring means having a fold concentrically surrounding said core.

2. A puck as recited in claim 1, said shell concentrically surrounding said spring means.

3. A puck as recited in claim 2, said core, spring and shell being a one-piece molded member.

4. A puck as recited in claim 2, said shell having an upper face, an opposing lower face, and a plurality of throughbores interposed between said upper face and said lower face, said puck further including:

a plurality of first and second mating glide pins each having a head, an opposing blunt tip, and a shank connecting said head to said blunt tip, said shank of said first glide pin having an inclined surface and said shank of said second glide pin having a correspondingly inclined surface for mating engagement of said first and second glide pins upon insertion into said throughbores.

5. A puck as recited in claim 4, each said shank of said first and second glide pins having interengaging toothed members.

6. A puck as recited in claim 4, each of said glide pins being constructed with a durometer within the range of 70 to 100 shore on the "D" scale and having a fiber fill content between 5 and 40 per-cent.

7. A puck as recited in claim 1, said core, shell, and spring means being constructed from polyvinylchloride including a plasticizer for maintaining constant density therein within the temperature range of at least 50° through 100° F.

8. A puck as recited in claim 1, including a center weight and means for mounting said center weight onto said core.

9. A puck as recited in claim 8, said center weight including:

a first piece having a first shank portion and a first massive portion outwardly-disposed;

a second piece having a second shank portion and a second massive portion outwardly-disposed; and connecting means for attaching said first piece to said second piece.

10. A puck as recited in claim 9, said connecting means for attaching said first piece to said second piece including:

said first shank portion having a threaded bore; and said second shank portion having exterior annular threads threadingly engaged with said threaded bore of said first shank portion.

11. A puck as recited in claim 9, said connecting means for attaching said first piece to said second piece including said first shank portion and said second shank portion each including interengaging toothed members disposed on mating surfaces of said first shank portion and said second shank portion.

12. A puck as recited in claim 1, said shell having a knurled exterior surface.

13. A puck comprising:

a core;

a shell concentrically surrounding said core, said shell having an upper face, an opposing lower face, an exterior surface, and a plurality of throughbores interposed between said upper face and said lower face, each of said throughbores having a diameter and a counterbore at said upper face and said lower face; and a plurality of first and second mating glide pins each having a head, an opposing blunt tip, and a shank connecting said head to said blunt tip, said shank of said first glide pin having an inclined surface and said shank of said second glide pin having a correspondingly inclined surface for mating engagement of said first and second glide pins, each said shank having a diameter greater than the diameter of each of said throughbores, said exterior surface of said shell having a flat spot between adjacent pins after inserting each of said glide pins through one of said throughbores until said head is proximate said counterbore.

* * * * *